US008936340B2

(12) United States Patent
Itogawa

(10) Patent No.: US 8,936,340 B2
(45) Date of Patent: Jan. 20, 2015

(54) DROPLET EJECTION APPARATUS AND METHOD OF CONTROLLING THE APPARATUS

(71) Applicant: Brother Kogyo Kabushiki Kaisha, Nagoya (JP)

(72) Inventor: Yoshihiro Itogawa, Mizuho (JP)

(73) Assignee: Brother Kogyo Kabushiki, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,972

(22) Filed: Mar. 28, 2013

(65) Prior Publication Data

US 2013/0257964 A1 Oct. 3, 2013

(30) Foreign Application Priority Data

Mar. 30, 2012 (JP) ..... 2012-080695

(51) Int. Cl.
*B41J 29/38* (2006.01)
*B41J 13/00* (2006.01)
*B41J 11/00* (2006.01)

(52) U.S. Cl.
CPC ..... *B41J 13/0009* (2013.01); *B41J 11/0005* (2013.01); *B41J 11/002* (2013.01)
USPC ..... 347/16

(58) Field of Classification Search
None
See application file for complete search history.

(56) References Cited

U.S. PATENT DOCUMENTS 5,784,090 A * 7/1998 Selensky et al. ..... 347/102
2009/0073211 A1 3/2009 Imoto
2009/0147039 A1 6/2009 Koase

FOREIGN PATENT DOCUMENTS

JP H05-338136 A 12/1993
JP H10-198080 A 7/1998
JP 2009-066905 A 4/2009
JP 2009-143010 A 7/2009

* cited by examiner

*Primary Examiner* — Lisa M Solomon
(74) *Attorney, Agent, or Firm* — Merchant & Gould PC

(57) ABSTRACT

A droplet ejection apparatus, including: an image-data storage; a droplet ejection head; a post-processing mechanism configured to perform drying processing and curl correction processing by a common processing technique on an image-formed recording medium; and a controller configured to: calculate a liquid ejection amount for each evaluation region on the recording medium; determine a first processing amount required for the drying processing, based on a maximum liquid ejection amount; determine, for each evaluation region, a second processing amount for the curl correction processing, based on the liquid ejection amount and a position of the evaluation region on the recording medium; and control the post-processing mechanism to perform the drying processing and the curl correction processing according to a maximum control amount of the post-processing mechanism among the first processing amount and the second processing amounts of the respective evaluation regions.

10 Claims, 9 Drawing Sheets

DROPLET EJECTION APPARATUS AND METHOD OF CONTROLLING THE APPARATUS

CROSS REFERENCE TO RELATED APPLICATION

The present application claims priority from Japanese Patent Application No. 2012-080695, which was filed on Mar. 30, 2012, the disclosure of which is herein incorporated by reference in its entirety.

BACKGROUND OF THE INVENTION

1. Field of the Invention

The present invention relates to a droplet ejection apparatus configured to eject droplets of a liquid such as ink to a recording medium and a method of controlling the apparatus. More particularly, the invention relates to a droplet ejection apparatus equipped with a post-processing mechanism configured to correct a curl of the recording medium to which the liquid is attached and to dry the liquid attached to the recording medium and a method of controlling such an apparatus.

2. Description of Related Art

There is known an ink-jet printer, as one example of a droplet ejection apparatus, configured to form an image on a recording medium by ejecting ink to a recording medium such as paper, cloth, or a film. The ink jet printer often uses water-soluble ink. The water-soluble ink contains a large amount of water as a solvent. Due to the water component contained in the ink, there may be caused a curl of the recording medium to which the ink has been attached by image formation. The state of the curl varies depending upon conditions of the attached ink. In general, when a difference in the amount of the water component becomes large between a front surface and a back surface of the recording medium due to the attachment of the ink to the recording medium, the curl is likely to occur. Where the recording medium suffers from the curl, the recording medium is not stacked in good order when discharged, causing a trouble that the recording medium is bent or placed out of position. Accordingly, it is preferable to accurately estimate or predict the state of the curl of the recording medium and to appropriately restrain the curl. In view of this, there is proposed a technique in which a liquid amount ejected by a droplet ejection apparatus to each of regions defined on the recording medium is calculated and a curl amount of the recording medium is predicted on the basis of a position of each region and the liquid amount ejected to the corresponding region. In the disclosed technique, a heat application time by a heater or a restraining time of a curl restraining mechanism for correcting the curl is increased where the amount of the curl is equal to or larger than a prescribed threshold.

In general, in an ink jet printer, ink is ejected to recording media that are successively supplied so as to form, an image thereon, and the recording media on each of which the image has been formed are sequentially discharged to an output tray so as to be stacked thereon. On this occasion, if in a state in which ink on a previously discharged recording medium is not dried yet, a following recording medium is subsequently discharged, there is caused the so-called set off in which the ink on the previously discharged recording medium is attached to the lower surface of the following recording medium. In view of this, there is proposed a technique in which a conveyance speed of a recording sheet necessary for drying the ink ejected to the recording sheet is calculated on the basis of the temperature of the vicinity of an ink-jet recording portion; and a ratio of black pixel elements in recording information, and the recording sheet is conveyed at a speed not higher than the calculated conveyance speed.

SUMMARY OF THE INVENTION

Where processing for correcting the curl and processing for drying the ink are performed individually in post-processing of the recording medium on which an image has been recorded, there may arise a need of implementing needless processing, resulting in a risk of deteriorating processing efficiency.

The present invention has been made to solve the problems described above. It is therefore an object of the invention to provide a droplet ejection apparatus in which first processing (e.g. drying processing) and second processing (e.g., curl correction processing) are performed altogether so as to enhance processing efficiency. It is also an object of the invention to provide a method of controlling such a droplet ejection apparatus.

The object indicated above may be attained according to one aspect of the invention, which provides a droplet ejection apparatus, comprising:

- an image-data storage section configured to store image data based on which an image is formed on a recording medium;
- a droplet ejection head configured to eject droplets of a liquid to form, on the recording medium, the image based on the image data stored in the image-data storage section;
- a post-processing mechanism configured to perform drying processing and curl correction processing by a common processing technique, on the recording medium on which the image based on the image data has been formed by the droplet ejection head;
- a discharged-sheet supporting portion configured to support the recording medium on which the drying processing and the curl correction processing have been performed by the post-processing mechanism; and
- a controller configured to:
  - calculate, on the basis of the image data, a liquid ejection amount that is an amount of the liquid ejected from the droplet ejection head, for each of a plurality of evaluation regions defined on the recording medium;
  - determine a first processing amount that is a control amount of the post-processing mechanism required for the drying processing, on the basis of a maximum one of the liquid ejection amounts of the respective evaluation regions;
  - determine, for each of the plurality of evaluation regions, a second processing amount that is a control amount of the post-processing mechanism required for the curl correction processing, on the basis of the liquid ejection amount and a position of the evaluation region on the recording medium; and
  - control the post-processing mechanism to perform the drying processing and the curl correction processing on the recording medium according to a maximum control amount of the post-processing mechanism among the first processing amount and the second processing amounts of the respective evaluation regions.

The object indicated above may be attained according to another aspect of the invention, which provides a droplet ejection apparatus, comprising:

an image-data storage section configured to store image data based on which an image is formed on a recording medium;

a droplet ejection head configured to eject droplets of a liquid to form, on the recording medium, the image based on the image data stored in the image-data storage section;

a post-processing mechanism configured to perform first processing and second processing by a common processing technique, on the recording medium on which the image based on the image data has been formed by the droplet ejection head;

a discharged-sheet supporting portion configured to support the recording medium on which the first processing and the second processing have been performed by the post-processing mechanism; and a controller configured to:

obtain a first processing amount required for the first processing;

obtain a second processing amount required for the second processing; and control the post-processing mechanism to perform the first processing and the second processing according to a maximum processing amount among the first processing amount and the second processing amount.

The object indicated above may be attained according to still another aspect of the invention, which provides a method of controlling a droplet ejection apparatus, comprising: an image-data storage section configured to store image data based on which an image is formed on a recording medium; a droplet ejection head configured to eject droplets of a liquid to form, on the recording medium, the image based on the image data stored in the image-data storage section; a post-processing mechanism configured to perform drying processing and curl correction processing by a common processing technique, on the recording medium on which the image based on the image data has been formed by the droplet ejection head; and a discharged-sheet supporting portion configured to support the recording medium on which the drying processing and the curl correction processing have been performed by the post-processing mechanism, the method comprising the steps of:

calculating, on the basis of the image data, a liquid ejection amount that is an amount of the liquid ejected from the droplet ejection head, for each of a plurality of evaluation regions defined on the recording medium;

determining a first processing amount that is a control amount of the post-processing mechanism required for the drying processing, on the basis of a maximum one of the liquid ejection amounts of the respective evaluation regions;

determining, for each of the plurality of evaluation regions, a second processing amount that is a control amount of the post-processing mechanism required for the curl correction processing, on the basis of the liquid ejection amount and a position of the evaluation region on the recording medium; and controlling the post-processing mechanism to perform the drying processing and the curl correction processing on the recording medium according to a maximum control amount of the post-processing mechanism among the first processing amount and the second processing amounts of the respective evaluation regions.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIG. 5A is ink ejection data of black ink, FIG. 5B is ink ejection data of cyan ink, FIG. 5C is ink ejection data of magenta ink, and FIG. 5D is ink ejection data of yellow ink;

DETAILED DESCRIPTION OF THE EMBODIMENTS

There will be explained a droplet ejection apparatus according to one embodiment of the invention with reference to the drawings. In the following embodiment, a droplet ejection apparatus according to the present invention is applied to an ink-jet printer in which ink is used as a liquid and an ink ejection head is used as a droplet ejection head.

Figure 1:
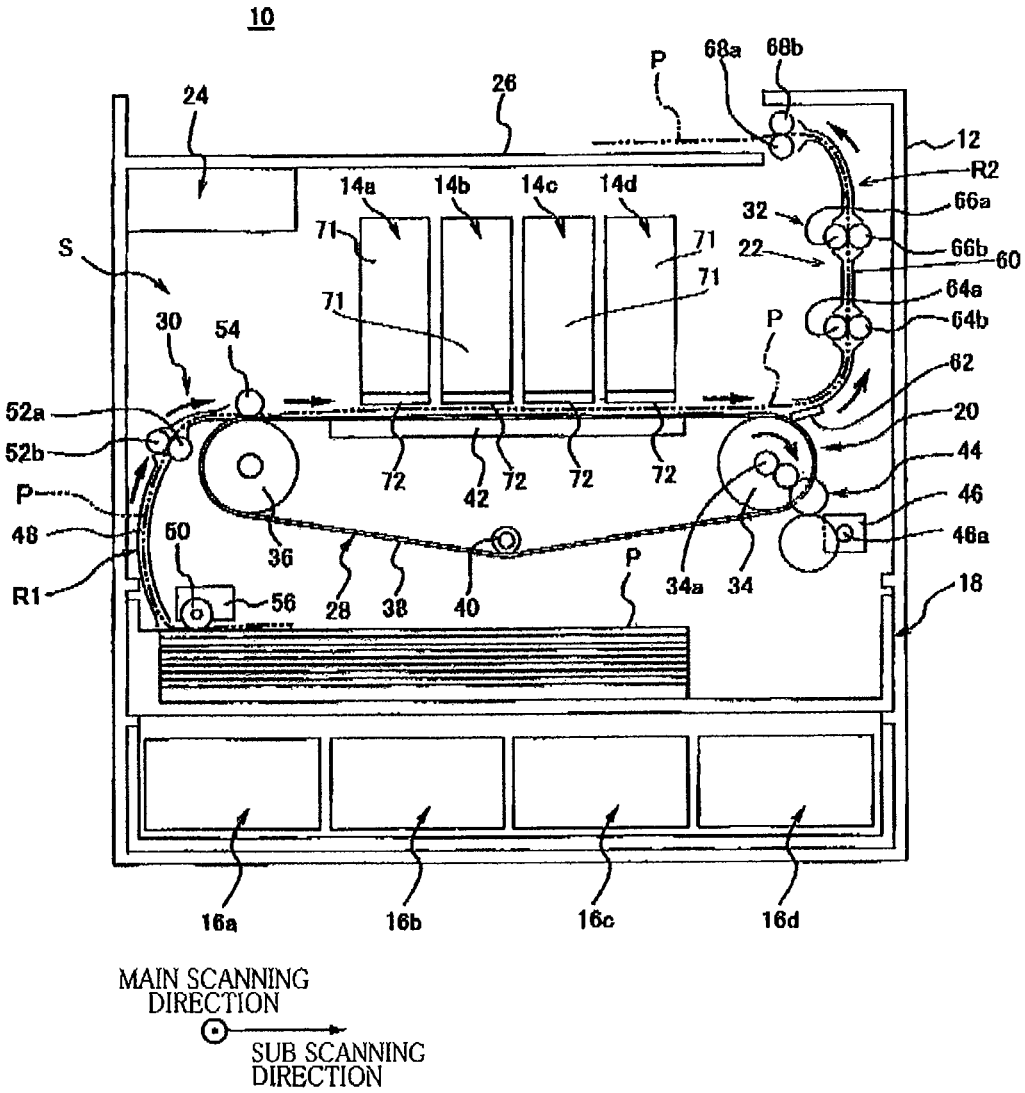
FIG. 1 is a schematic view showing a structure of an ink-jet printer according to one embodiment of the invention.
Figure 2:
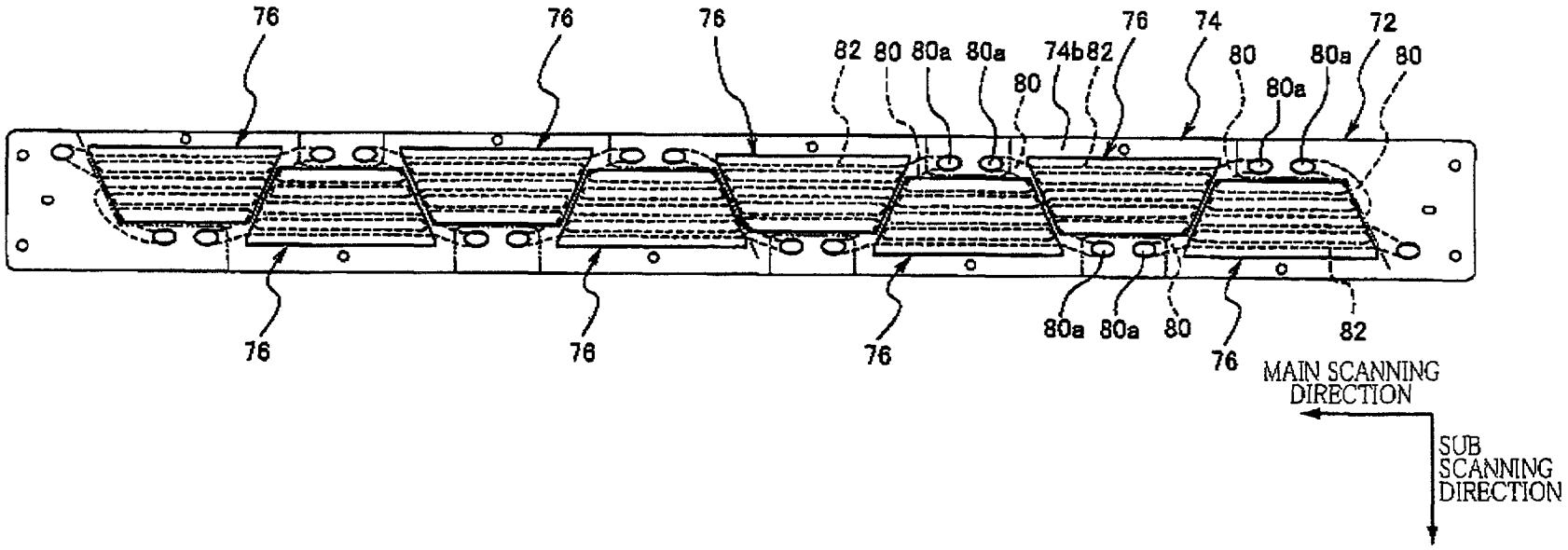
FIG. 2 is a plan view showing a structure of an ink ejection head used in the ink-jet printer.
Figure 3:
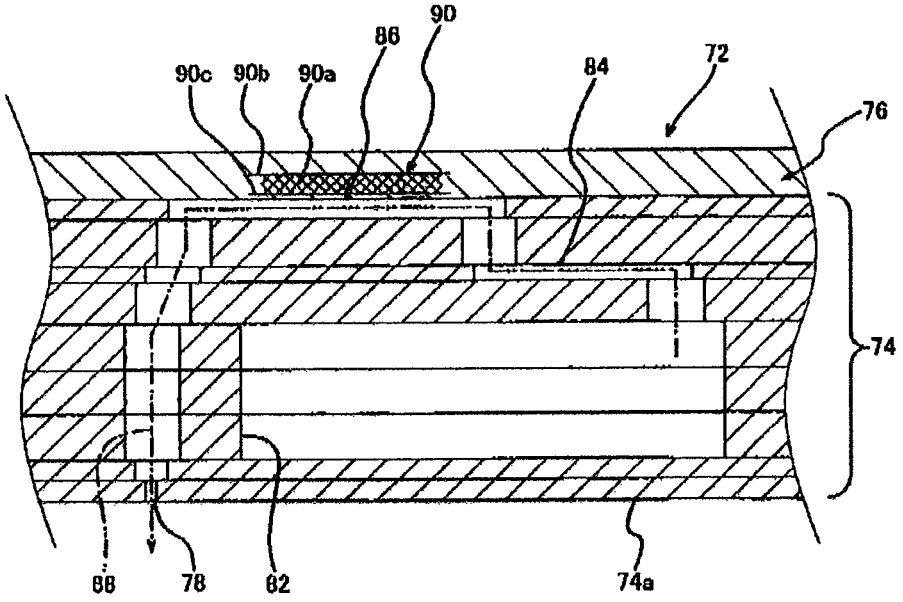
FIG. 3 is an enlarged fragmentary view in cross section showing the structure of the ink ejection head.

FIG. 1 is a schematic view showing a structure of an ink jet printer 10 according to one embodiment of the invention. FIG. 2 is a plan view showing a structure of an ink ejection head 72 used in the ink-jet printer 10. FIG. 3 is an enlarged fragmentary view in cross section showing the structure of the ink ejection head 72.

Figure 4:
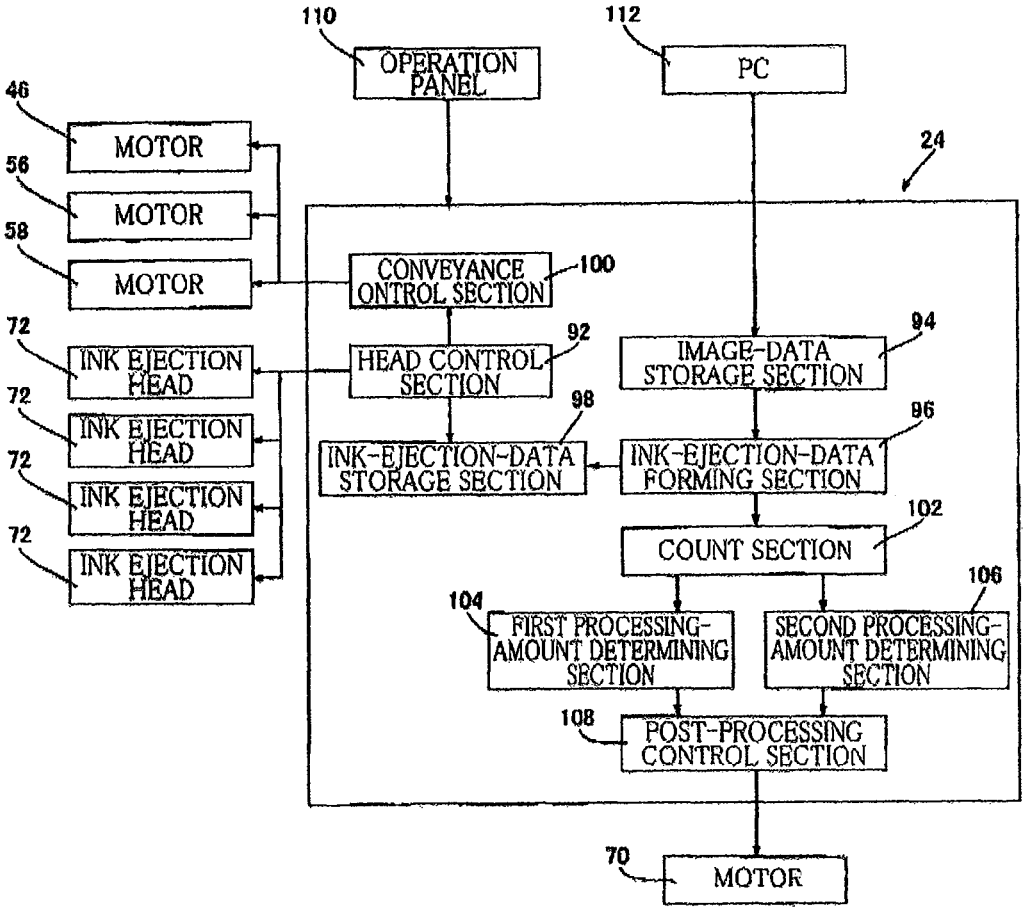
FIG. 4 is a functional block diagram of a controller.

As shown in FIG. 1, the ink-jet printer 10 includes a casing 12, four head units 14*a*-14*d* respectively corresponding to inks of four colors (black, cyan, magenta, yellow), and four ink tanks 16*a*-16*d* respectively storing the inks of the four colors. The ink-jet printer 10 further includes a recording-medium accommodating portion 18 for accommodating a recording medium P such as paper, cloth, or a film, a conveyor mechanism 20 configured to convey the recording medium P, a post-processing mechanism 22, and a controller 24 configured to execute various controls. In the present embodiment, the controller 24 controls the post-processing mechanism 22. As shown in FIG. 4, the controller 24 includes an image-data storage section 94 configured to store image data.

As shown in FIG. 1, the casing 12 has a space S in which various components are accommodated. On the upper surface of the casing 12, there is provided an output tray 26 (as one example of a discharged-sheet supporting portion) configured to support the recording medium P discharged by the conveyor mechanism 20 to the exterior of the casing 12. In this respect, where an option tray (not shown) is used as a target portion to which the recording medium P is discharged, the option tray functions as the discharged-sheet supporting portion. The ink tanks 16*a*-16*d* are disposed at the lower portion of the space S, and the recording-medium accommodating portion 18 is disposed in the lower portion of the space S above the ink tanks 16*a*-16*d*. The head units 14*a*-14*d* and the controller 24 are disposed at the upper portion of the space S. The conveyor mechanism 20 is disposed at a region of the space S ranging from the middle portion of the space S in the up-and-down direction to the upper portion thereof. The post-processing mechanism 22 is disposed at the upper portion of the space S in the vicinity of the conveyor mechanism 20.

As shown in FIG. 1, the conveyor mechanism 20 includes a conveyor unit 28 configured to convey the recording medium P in the horizontal direction, a supply unit 30 that is provided on the upstream side of the conveyor unit 28 in a conveyance direction in which the recording medium P is conveyed and that is configured to supply the recording medium P accommodated in the recording-medium accommodating portion 18 to the conveyor unit 28, and a discharge unit 32 that is provided on the downstream side of the conveyor unit 28 in the conveyance direction and that is configured to discharge the recording medium P to the output tray 26.

The conveyor unit 28 includes a pair of belt rollers 34, 36, an annular conveyor belt 38 stretched between the belt rollers 34, 36, a tension roller 40 pressed onto the conveyor belt 38, and a platen 42 that horizontally supports an upper part of the loop of the conveyor belt 38. A rotation shaft 46*a* of a motor 46 is connected to a rotation shaft 34*a* of the belt roller 34 via a gear unit 44. As shown in FIG. 4, the motor 46 is electrically connected to the controller 24. As shown in FIG. 1, in the present embodiment, the conveyance direction of the recording medium P by the conveyor unit 28 corresponds to a sub scanning direction, and a direction that is orthogonal to the conveyance direction of the recording medium P and that is along the horizontal plane corresponds to a main scanning direction.

The supply unit 30 includes: a guide 48 that defines a supply passage R1 extending in the up-and-down direction; a supply roller 50 provided in the vicinity of an upstream end portion of the guide 48 and configured to supply, to the supply passage R1, the uppermost recording medium P accommodated in the recording-medium accommodating portion 18; a pair of feed rollers 52*a*, 52*b* provided in the supply passage R1; and a nip roller 54 provided in the vicinity of a downstream end portion of the guide 48 and configured to press the recording medium P onto the surface of the conveyor belt 38. The supply unit 30 further includes a motor 56 (FIG. 4) configured to drive the supply roller 50 and a motor 58 (FIG. 4) configured to drive the feed rollers 52*a*, 52*b* and the nip roller 54. As shown in FIG. 4, the motors 56, 58 are electrically connected to the controller 24.

The discharge unit 32 includes: a guide 60 that defines a discharge passage R2 extending in the up-and-down direction; a separation plate 62 provided in the vicinity of an upstream end portion of the discharge passage R2 and configured to separate the recording medium P away from the surface of the conveyor belt 38; a pair of first transfer rollers 64*a*, 64*b* provided in the discharge passage R2; a pair of second transfer rollers 66*a*-66*b* provided in the discharge passage R2 so as to be spaced apart from the first transfer rollers 64*a*, 64*b* toward the downstream side in the conveyance direction; and a pair of discharge rollers 68*a*, 68*b* provided in the vicinity of a downstream end portion of the guide 60. The discharge unit 32 further includes a motor 70 (FIG. 4) configured to drive the first transfer rollers 64*a*, 64*b*, the second transfer rollers 66*a*, 66*b*, and the discharge rollers 68*a*, 68*b*. As shown in FIG. 4, the motor 70 is electrically connected to the controller 24.

As shown in FIG. 1, the first transfer rollers 64*a*, 64*b* and the second transfer rollers 66*a*, 66*b* are configured to convey, to the output tray 26, the recording medium P on which the image has been formed by the ink ejection heads 72 while keeping the shape of the recording medium P. The rotation speeds of the first transfer rollers 64*a*, 64*b* and the second transfer rollers 66*a*, 66*b* can be controlled by controlling the motor 70 (FIG. 4) by means of the controller 24. Accordingly, in an instance where a long time is required for drying processing and curl correction processing to be performed on the recording medium P, the controller 24 controls the motor 70 (FIG. 4) so as to decrease the rotation speeds of the rollers or so as to halt rotations of the rollers, thereby increasing the required time for the drying processing and the curl correction processing. On the other hand, in an instance where a long time is not required for the drying processing and the curl correction processing to be performed on the recording medium P, the controller 24 controls the motor 70 (FIG. 4) so as to increase the rotation speeds of the rollers, thereby enhancing printing throughput. That is, in the present embodiment, the post-processing mechanism 22 configured to perform the drying processing and the curl correction processing on the recording medium P by a common processing technique is constituted by the discharge unit 32 of the conveyor mechanism 20. A control amount of the post-processing mechanism 22 necessary for the drying processing and the curl correction processing is a rotation speed or a halt time of the motor 70 (FIG. 4).

As shown in FIG. 1, the head units 14*a*-14*d* are disposed above the conveyor unit 28 so as to be arranged in the sub scanning direction. Each of areas located below the respective head units 14*a*-14*d* is an ejection area to which a corresponding one of the four inks is ejected. Each of the head units 14*a*-14*d* has: a head holder 71 having a substantially rectangular parallelepiped shape and extending in the main scanning direction; and the ink ejection head 72 disposed on the lower surface of the corresponding head holder 71 so as to extend in the main scanning direction. That is, the ink jet printer 10 of the present embodiment is a line-type printer.

As shown in FIGS. 2 and 3, the ink ejection head 72 of each of the head units 14*a*-14*d* includes a flow-passage unit 74 and a plurality of drive portions 76 (eight drive portions 76 in the present embodiment) bonded to an upper surface 74*b* of the flow-passage unit 74. As shown in FIG. 3, the flow-passage unit 74 is a stacked body composed of a plurality of metal plates, and the lower surface of the flow-passage unit 74 functions as a nozzle surface 74*a* in which a plurality of nozzles 78 are formed. In the flow-passage unit 74, there are formed: manifolds 80 (FIG. 2); sub manifolds 82 communicating with the corresponding manifolds 80 (FIG. 2); and a plurality of individual ink channels 88 each extending from the corresponding sub manifold 82 to the corresponding nozzle 78 through a corresponding aperture 84 and a corresponding pressure chamber 86. As shown in FIG. 2, a plurality of ink supply openings 80*a* each communicating with the corresponding manifold 80 are formed in the upper surface 74*b* of the flow-passage unit 74. There is disposed, above the ink ejection head 72 in each the head holder 71 shown in FIG. 1, a reservoir (not shown) communicating with the ink supply openings 80*a* (FIG. 2). Each reservoir is connected to a corresponding one of the ink tanks 16*a*-16*d* via a tube and a pump (both of which are not shown).

As shown in FIG. 2, the drive portions 76 are arranged along the main scanning direction. As shown in FIG. 3, each of the drive portions 76 has a plurality of actuators 90 (one of which is illustrated in a check pattern in FIG. 3). The actuators 90 respectively correspond to the pressure chambers 86. Each of the actuators 90 includes a piezoelectric layer 90*a* and a pair of electrodes 90*b*, 90*c* between which the piezoelectric layer 90*a* is sandwiched. When a drive voltage is applied between the electrodes 90*b*, 90*c* from a head control section 92 (FIG. 4), the piezoelectric layer 90*a* contracts in a direction orthogonal to the direction of thickness thereof, so that a part of the drive portion 76 located below the piezoelectric layer 90*a* deforms so as to protrude or to be convex into the pressure chamber 86. As a result, the volume of the pressure chamber 86 is decreased. This state corresponds to a basic state. When the ground voltage is applied between the electrodes 90*b*, 90*c* in the basic state, the contracted state of the piezoelectric layer 90*a* is cancelled, so that the volume of the pressure chamber 86 is increased. Accordingly, where the ground voltage is instantaneously applied between the electrodes 90*b*, 90*c* in the basic state, the volume of the pressure chamber 86 changes at timing at which the ground voltage is applied, so that an ejection energy is given to the ink in the pressure chamber 86. Owing to the ejection energy, the ink is ejected from the nozzle 78.

FIG. 4 is a functional block diagram of the controller 24. The controller 24 shown in FIG. 4 is a computer including a CPU, a nonvolatile memory that stores programs to be executed by the CPU and that rewritably stores various data, and a RAM configured to temporarily store data when the programs are executed. The CPU, the nonvolatile memory, and the RAM are not shown. The controller 24 operates according to the programs, thereby realizing the following functional sections: an image-data storage section 94, an ink-ejection-data, forming section 96, an ink-ejection-data storage section 98, a head control section 92, a conveyance control section 100, a count section 102, a first processing-amount determining section 104, a second processing-amount determining section 106, and a post-processing control section 108. There is connected, to the controller 24, an operation panel 110 through which various information is inputted.

As shown in FIG. 4, the image-data storage section 94 is configured to store image data based on which an image is to be recorded on the recording medium P (FIG. 1). There are connected, to the ink-jet printer 10, an external computer 112 configured to form the image data, a reading device (not shown) configured to read the image data from a storage medium, etc. The image data is sent to the image-data storage section 94 from the external computer 112, the reading device, etc.

Figure 5A:
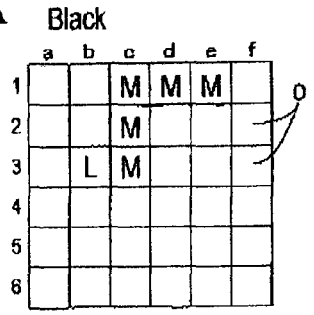
FIGS. 5A-5D are views showing ink ejection data of a certain region for respective colors, more specifically.
Figure 5B:
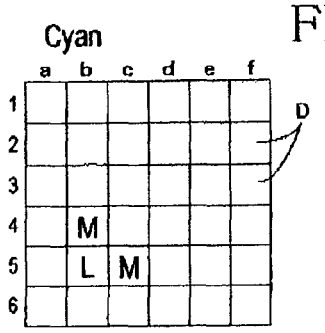
Figure 5C:
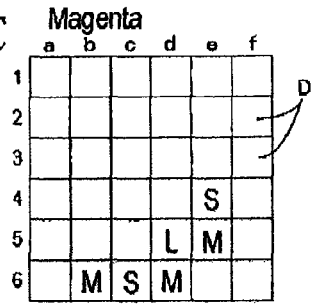
Figure 5D:
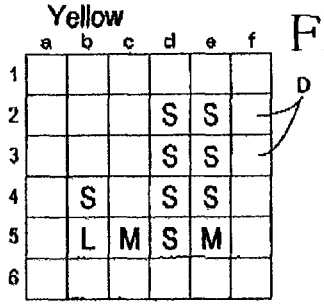

FIGS. 5A-5D are views showing ink ejection data of a certain region for respective colors. More specifically, FIG. 5A is ink ejection data of black ink, FIG. 5B is ink ejection data of cyan ink, FIG. 5C is ink ejection data of magenta ink, and FIG. 5D is ink ejection data of yellow ink. The four sorts of ink ejection data shown in FIG. 5 corresponds to an image to be formed on the same region of the recording medium P constituted by thirty six unit regions D in total ranging over six rows from "1"-"6" and six columns from "a" to "f".

The ink-ejection-data forming section 96 shown in FIG. 4 is configured to form the ink ejection data (FIG. 5) on the basis of the image data stored in the image-data storage section 94. The ink ejection data indicates a size of a dot (dot size) to be formed on each of the unit regions D (pixel regions) virtually defined on the recording medium P. The dot size indicated by the ink ejection data indicates a size of an ink droplet to be ejected by each ink ejection head 72 (FIG. 1) to each unit region on the recording medium P, i.e., a droplet size corresponding to zero, a small droplet, a medium droplet, or a large droplet. Each of the characters "S", "M", and "L" in FIG. 5 represents the size of the dot to be formed on each unit region D virtually defined on the recording medium P, i.e., the small droplet, the medium droplet, and the large droplet. No dots are to be formed on unit regions in which no characters are described, namely, the dot size corresponds to zero. Mutually different dot sizes mean mutually different droplets amounts of the ink to be ejected to the unit regions D, The ink ejection data (FIG. 5) formed by the ink-ejection-data forming section 96 is sent from the ink-ejection-data forming section 96 to the ink-ejection-data storage section 98.

The ink-ejection-data storage section 98 shown in FIG. 4 is configured to store the four sorts of ink ejection data (FIG. 5) respectively corresponding to the four ink ejection heads 72 (FIG. 1). The ink-ejection-data storage section 98 stores the ink ejection data (FIG. 5) corresponding to at least one page.

The head control section 92 shown in FIG. 4 is configured to generate drive signals in which the voltage changes in a pulse-like pattern, on the basis of the ink ejection data stored in the ink-ejection-data storage section 98. The head control section 92 controls ink ejection operations of the ink ejection heads 72 according to the drive signals. The head control section 92 is configured to change the amount of the ink ejected from each ink ejection head 72 in four steps, i.e., zero, the small droplet, the medium droplet, and the large droplet. The conveyance control section 100 is configured to control the motors 46, 56, 58 such that the recording medium P is conveyed through the supply unit 30, the conveyor unit 28, and the discharge unit 32 (FIG. 1).

Figure 6:
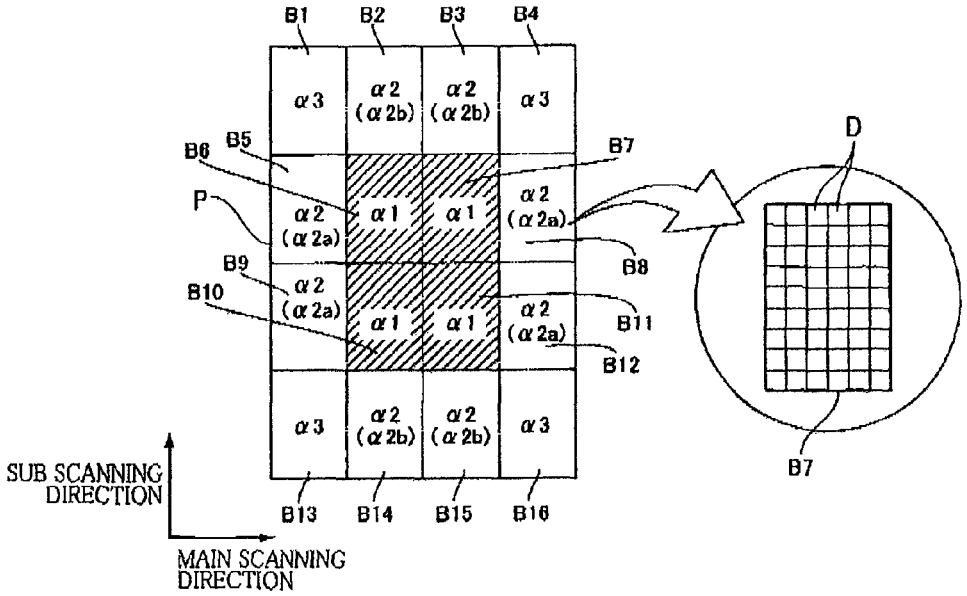
FIG. 6 is a view showing a relationship between a plurality of evaluation regions defined on a recording medium and unit regions.

FIG. 6 shows a relationship between a plurality of evaluation regions B and the plurality of unit regions D defined on the recording medium P. The evaluation regions B can be distinguished from one another depending upon respective positions on the recording medium P. In the following explanation, where it is necessary to distinguish the plurality of evaluation regions B from one another, the evaluation regions are referred to as B1-B16. Where it is not necessary to distinguish the plurality of evaluation regions B from one another, the evaluation regions are simply referred to as the evaluation regions B. While the respective evaluation regions are indicated by using symbols B1-B6 in FIG. 6, the evaluation regions will be collectively referred to as the evaluation regions B where appropriate.

The count section 102 shown in FIG. 4 is configured to obtain the ink ejection data in the process in which the ink ejection data is sent from the ink-ejection-data forming section 96 to the ink-ejection-data storage section 98 and to successively count a number of droplets (droplet number) and an ejection amount of the ink (ink ejection amount) for each of the plurality of evaluation regions B (FIG. 6). As shown in FIG. 6, in the present embodiment, one recording medium P is divided into four rows in the sub scanning direction and four columns in the main scanning direction, so that one recording medium P is divided into sixteen evaluation regions B. Each evaluation region B is a region consisting of a plurality of unit regions D (pixel regions).

The droplet number of the ink in each evaluation region B corresponds to a number of ink droplets ejected from a corresponding one of the four ink ejection heads 72 (FIG. 1) to the evaluation region B. In the present embodiment, the droplet number of a certain evaluation region B is obtained first by counting the dot number of the evaluation region B in question for each of the ink ejection data of the black ink, the cyan ink, the magenta ink, and the yellow ink, and then by summing up the droplet numbers for the black ink, the cyan ink, the magenta ink, and the yellow ink. Where the four sorts of ink ejection data of FIGS. 5A-5D, each of which is constituted by the thirty six unit regions D (six rows×six columns), correspond to a certain one evaluation region B, the droplet number of this evaluation region B is twenty six (=six black droplets+three cyan droplets+six magenta droplets+eleven yellow droplets).

The ink ejection amount in each evaluation region B corresponds to a total of the ink droplet amounts ejected to the evaluation region B from the respective four ink ejection heads 72 (FIG. 1). Accordingly, the ink ejection amount of a certain evaluation region B is obtained by summing up products each obtained by multiplying the number of dots of each dot size (S, M, L) in the ejection data of all colors of inks corresponding to the evaluation region B in question, by the droplet amount of the corresponding dot size. Where the four sorts of ink ejection data of FIGS. 5A-5D, each of which is constituted by the thirty six unit regions D (six rows×six columns), corresponds to a certain one evaluation region B, for instance, the number of the S-size dots, the M-size dots, and the L-size dots of this evaluation region B are ten, twelve, and four, respectively. Where the droplet amounts of the S-size dot, the M-size dot, and the L-size dot are 7 pl, 14 pl, and 21 pl, respectively, the ejection amount of this evaluation region B is equal to 322 pl (=10×7 pl+12×14 pl+4×21 pl).

The first processing-amount determining section 104 shown in FIG. 4 is configured to determine a first processing amount U that is a control amount of the post-processing mechanism 22 (FIG. 1) necessary for the drying processing, on the basis of a maximum one of the ink ejection amounts of the respective evaluation regions B. The ink ejection amount of each evaluation region B is calculated in the count section 102 on the basis of the image data as described above. The time required for drying the ink in each evaluation region B is determined on the basis of data (table data) as to "drying time with respect to ink ejection amount" obtained by experiments. The first processing amount U in the present embodiment is a rotation speed of the motor 70 that corresponds to the conveyance speed of the recording medium P in the post-processing mechanism 22 or a halt time of the motor 70 that corresponds to a halt time during which the conveyance of the recording medium P is halted or suspended in the post-processing mechanism 22. The first processing amount U, namely, the control amount of the post-processing mechanism 22, is determined on the basis of data (table data) as to "control amount with respect to drying time" obtained by experiments. In other words, the first processing-amount determining section 104 is configured to determine the first processing amount U on the basis of the maximum one of the ink ejection amounts of the respective evaluation regions B, the data as to "drying time with respect to ink ejection amount", and the data as to "control amount with respect to drying time".

Further, the first processing-amount determining section 104 is configured to determine the first processing amount U, such that the larger the droplet number of the ink ejected to one of the evaluation regions B based on which the first processing amount U is determined, the smaller the first processing amount U. Where the ink ejection amount is the same, the ink ejected to the recording medium P can be dried more quickly with an increase in the droplet numbers, namely, with an increase in an area to which the ink is ejected (ejected area). Accordingly, it is possible to enhance processing efficiency by determining the first processing amount U such that the larger the droplet number, the smaller the first processing amount U.

The second processing-amount determining section 106 is configured to determine second processing amounts Q1-Q16 for the respective evaluation regions B1-B16 on the basis of respective ink ejection amounts of the evaluation regions B1-B16 and respective positions of the evaluation regions B1-B16 on the recording medium P. Each of the second processing amounts Q1-Q16 is a control amount of the post-processing mechanism 22 (FIG. 1) necessary for the curl correction processing. The ink ejection amount in each of the evaluation regions B1-B16 is determined by the count section 102 on the basis of the image data as described above.

The second processing-amount determining section 106 is configured to determine the second processing amounts Q1-Q16 as follows. Initially, curl-correction reference times t1-t16 are determined on the basis of data (table data) as to "curl-correction reference time with respect to ink ejection amount" obtained by experiments. Subsequently, more accurate times T1-T16 necessary for correcting a curl in each of the evaluation regions B1-B16 (hereinafter referred to as the "curl correction times" where appropriate) are calculated by multiplying each of the curl-correction reference times t1-t16 by a coefficient $\alpha$ (any one of $\alpha$1, $\alpha$2, $\alpha$3 in the present embodiment) which is set depending upon the position on the recording medium P. Thereafter, the second processing amounts Q1-Q16 (each as the control amount) are determined on the basis of data (table data) as to "control amount with respect to curl correction time". In the following explanation, the second processing amounts Q1-Q16 may be simply referred to as the second processing amounts Q where appropriate.

The curl-correction reference times t1-t16 are the curl correction times that correspond to the respective evaluation region B1-B16 in an instance where the positions of the respective evaluation regions B1-B16 on the recording medium P are ignored or are not taken into account. Each of the curl correction times T1-T16 in the respective evaluation regions B1-B16 is calculated by multiplying a corresponding one of the curl-correction reference times t1-t16 by the coefficient $\alpha$ (any one of $\alpha$1, $\alpha$2, $\alpha$3 in the present embodiment) which is set depending upon the position on the recording medium P.

In the present embodiment, the coefficient $\alpha$1 is set for four evaluation regions B6, B7, B10, B11 that are located at a central portion of the recording medium P, and the coefficient $\alpha$2 ($\alpha$2>$\alpha$1) is set for eight evaluation regions B2, B3, B5, B8, B9, B12, B14, B15 that are located at an end portion of the recording medium P (except for four corner portions of the recording medium P). Further, the coefficient $\alpha$3 ($\alpha$3>$\alpha$2>$\alpha$1) is set for four evaluation regions B1, B4, B13, B16 that are located at the respective four corner portions of the recording medium P. Here, the end portion of the recording medium P is a concept that includes longitudinally opposite end portions and widthwise opposite end portions of the recording medium P, and may be referred to as a perimeter or a peripheral portion of the recording medium P. As described above, each of the curl correction times T1-T16 of the respective evaluation regions B1-B16 is calculated by multiplying a corresponding one of the curl-correction reference times t1-t16 by any one of the coefficients $\alpha$1, $\alpha$2, $\alpha$3. For instance, the curl correction time T6 for the evaluation region B6 located at the central portion of the recording medium P is calculated according to an equation T6=t6×$\alpha$1. The curl correction time T2 for the evaluation region B2 located at the end portion (except the corner portions) of the recording medium P is calculated according to an equation T2=t2×$\alpha$2. The curl correction time T1 for the evaluation region B1 located at one corner portion of the recording medium P is calculated according to an equation T1=t1×$\alpha$3. The second processing amounts Q1-Q16 are determined on the basis of the data (table data) as to "control amount with respect to curl correction time".

Thus, in the present embodiment, the second processing amounts Q of the respective evaluation regions B are determined such that the second processing amount Q is larger in each of the evaluation regions B located at the end portion of the recording medium P than in each of the evaluation regions B located at the central portion of the recording medium P, by multiplying each of the curl-correction reference times t1-t16 by any one of the coefficients $\alpha$1, $\alpha$2, $\alpha$3 ($\alpha$3>$\alpha$2>$\alpha$1). That is, the closer the evaluation region B is to the end portion of the recording medium P, the larger the second processing amount Q, even where the ejection amount is the same. In the recording medium P, the ink ejection amount in each of the evaluation regions located at the end portion contributes to occurrence of the curl to a greater degree than the ink ejection amount in each of the evaluation regions B located at the central portion. In view of this, the coefficient $\alpha$ is made larger for each of the evaluation regions located at the end portion than each of the evaluation regions B located at the central portion, thereby making the second processing amounts Q larger so as to effectively restrain the curl of the recording medium P.

Where the recording medium P is a paper sheet, it is known that the curl is likely to occur more frequently in a direction orthogonal to a fiber direction of the sheet than in the fiber direction. In the present embodiment, therefore, the second processing-amount determining section 106 is configured to classify eight evaluation regions B2, B3, B5, B8, 89, B12, B14, B15 located at the end portion of the recording medium P (except the four corner portions of the recording medium P) into: the evaluation regions B2, B3, B14, B15 located at opposite ends of the recording medium P in the fiber direction; and the evaluation regions B5, B8, 89, B12 located at opposite ends of the recording medium P in the direction orthogonal to the fiber direction and to set a coefficient $\alpha$2*a* for the evaluation regions B5, B8, B9, B12 so as to be larger than a coefficient $\alpha$2*b* for the evaluation regions 82, B3, B14, B15 ($\alpha$3>$\alpha$2*a*>$\alpha$2*b*>$\alpha$1). According to the arrangement, it is possible to restrain the curl of the recording medium P more effectively. Such a measure based on the fiber direction may be conducted on the basis of instruction signals inputted by a user through the operation panel 110.

The post-processing control section 108 is configured to control the post-processing mechanism 22 (FIG. 1) according to a maximum control amount of the post-processing mechanism 22 (FIG. 1) among the first processing amount U and the second processing amounts Q1-Q16 of the respective evaluation regions B1-B16 and to thereby perform the drying processing and the curl correction processing of the recording medium P, The control amount in the present embodiment is the rotation speed of the motor 70 that corresponds to the conveyance speed of the recording medium P in the post-processing mechanism 22 or the halt time of the motor 70 that corresponds to the halt time during which the conveyance of the recording medium P is halted or suspended in the post-processing mechanism 22. The post-processing control section 108 controls the rotation speed or the halt time of the motor 70 on the basis of the maximum control amount indicated above.

Figure 7:
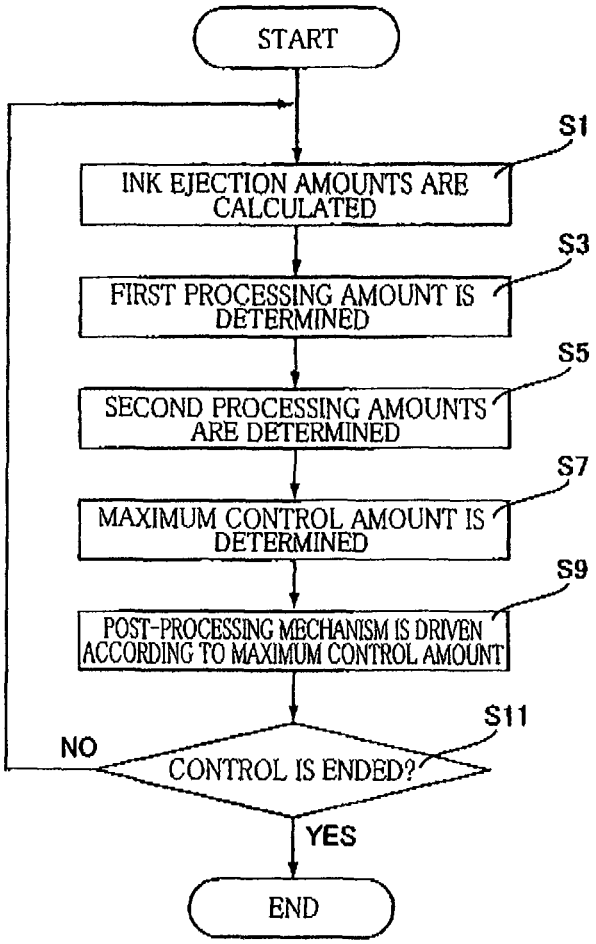
FIG. 7 is a flow chart showing a flow of control of a post-processing mechanism by a controller.

FIG. 7 is a flow chart showing a flow of control of the post-processing mechanism 22 (FIG. 1) by the controller 24. As shown in FIG. 7, when the control operation by the controller 24 is carried out, the ink ejection amounts of the respective evaluation regions B1-B16 (FIG. 6) are calculated by the count section 102 (FIG. 4) in step S1. Subsequently, in step S3, the first processing amount U that is the control amount of the post-processing mechanism 22 (FIG. 1) necessary for the drying processing is determined by the first processing-amount determining section 104 (FIG. 4). The first processing amount U determined in step S3 may be one processing amount that corresponds to one of the plurality of evaluation regions B in which the ink ejection amount is maximum or may be a plurality of processing amounts that correspond to the plurality of evaluation regions B including the evaluation region B in which the ink ejection amount is maximum. Next, in step S5, the second processing amounts Q1-Q16 for the respective evaluation regions B1-B16 are determined by the second processing-amount determining section 106 (FIG. 4), each of the second processing amounts Q1-Q16 being the control amount of the post-processing mechanism 22 (FIG. 1) necessary for the curl correction processing.

In step S7, a maximum control amount of the post-processing mechanism 22 (FIG. 1) among the first processing amount U and the second processing amounts Q1-Q16 of the respective evaluation regions B1-B16 is determined by the post-processing control section 108 (FIG. 4). In step S9, the post-processing mechanism 22 (FIG. 1) is driven according to the determined maximum control amount, That is, where the control amount is the rotation speed of the motor 70, the rotation speed of the motor 70 is controlled according to the maximum control amount so as to obtain a necessary time for the drying processing and the curl correction processing and the conveyance speed of the recording medium P is adjusted.

Where the control amount is the halt time of the motor 70, the halt time of the motor 70 is controlled according to the maximum control amount so as to obtain a necessary time for the drying processing and the curl correction processing and the halt time of the recording medium P is adjusted. According to the arrangement, it is possible to efficiently perform the drying processing and the curl correction processing on the recording medium P without a need of implementing needless processing. In the next step S11, it is judged whether the control of the post-processing mechanism 22 (FIG. 1) is ended or not. Where an affirmative decision YES is made, the control is ended. Where a negative decision NO is obtained, the control flow returns to step S1.

In the present embodiment, the drying processing (the first processing) and the curl correction processing (the second processing) of the recording medium P is conducted according to the maximum processing amount among the first processing amount U necessary for the drying processing (the first processing) and the second processing amounts Q1-Q16 of the respective evaluation regions B1-B16 necessary for the curl correction processing (the second processing), namely, according to the maximum control amount of the post-processing mechanism 22 (FIG. 1). Accordingly, the drying processing and the curl correction processing are performed altogether, thereby preventing needless processing from being implemented. In the present embodiment, the drying processing and the curl correction processing can be efficiently performed on the basis of the minimum necessary processing amount.

In the evaluation region B located at the central portion of the recording medium P, the curl is not likely to occur irrespective of the ink ejection amount. Therefore, the necessity to correct the curl is low in the evaluation region B in question. In the present embodiment, the controller 24 (FIG. 1) is configured to determine the second processing amounts Q1-Q16 of the respective evaluation regions B1-B16 such that the second processing amounts Q1-Q16 are larger in the evaluation regions located at the end portion of the recording medium P than in the evaluation regions located at the central portion of the recording medium P, whereby the processing amount of the recording medium P by the post-processing mechanism 22 (FIG. 1) can be appropriately determined.

Modified Embodiments

Figure 8:
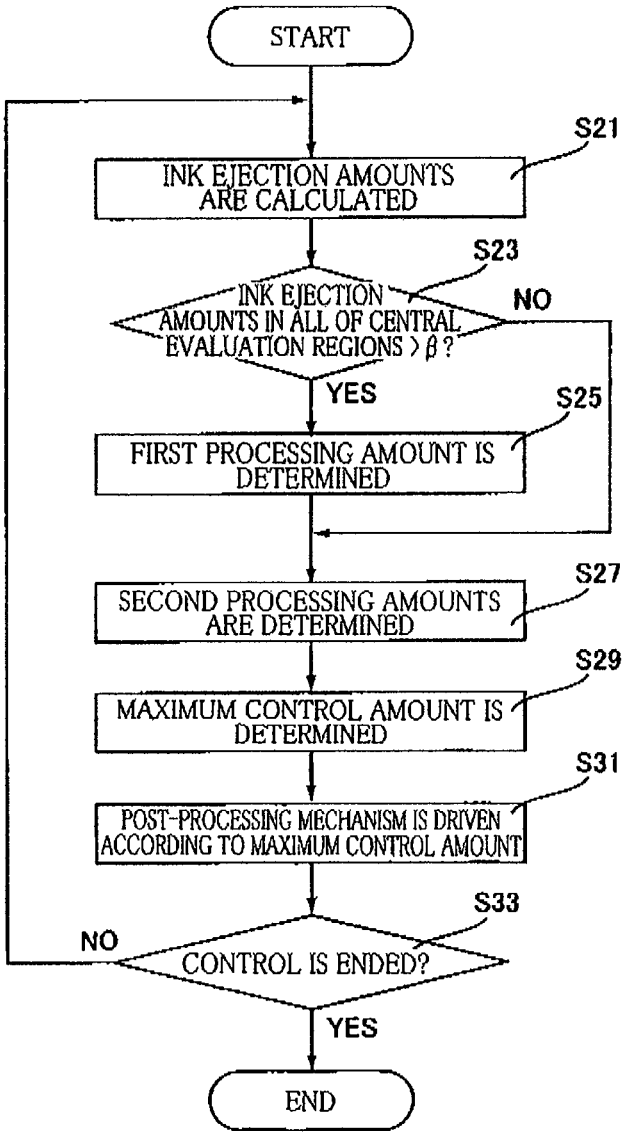
FIG. 8 is a flow chart showing a flow of control of the post-processing mechanism by the controller in a modified embodiment.

FIG. 8 is a flow chart showing a flow of control of the post-processing mechanism 22 (FIG. 1) by the controller 24 in a modified embodiment of the invention. In evaluation regions B6, B7, B10, B11 located at the central portion of the recording medium P shown in FIG. 6 (hereinafter referred to as the "central evaluation regions" where appropriate), the curl is not likely to occur irrespective of the ink ejection amount. Therefore, the necessity to correct the curl is low in those central evaluation regions. On the other hand, in evaluation regions B1-B5, B8, B9, B12-B16 located at the end portion of the recording medium P shown in FIG. 6 (hereinafter referred to as the "end evaluation regions" where appropriate), the degree to which the ink ejection amount influences the curl amount is high. Accordingly, when focusing on any one of the end evaluation regions, the processing amount necessary for the curl correction processing is always larger than the processing amount necessary for the drying processing. Therefore, the necessity to determine the second processing amounts Q necessary for the curl correction processing is low in the central evaluation regions while the necessity to consider the end evaluation regions in determining the first processing amount U necessary for the drying processing is low in the end evaluation regions. In view of this, in the modified embodiment shown in FIG. 8, the second processing amounts Q are determined such that the second processing amounts Q of the evaluation regions B except for at least one central evaluation region B are determined, and the first processing amount U is determined without considering at least one end evaluation region B.

In the modified embodiments shown in FIG. 8, when the control operation by the controller 24 is executed, the ink ejection amounts of the respective evaluation regions B1-B16 (FIG. 6) are initially calculated in step 21 by the count section 102 shown in FIG. 4. In the following step S23, it is judged whether the ink ejection amounts in all of the central evaluation regions 86, B7, B10, B11 are larger than a prescribed threshold β. Where an affirmative decision YES is obtained, namely, where it is judged that the ink ejection amounts in all of the central evaluation regions B6, B7, B10, B11 are larger than the prescribed threshold β, the first processing amount U is determined in the following step S25 on the basis of a maximum one of the ink ejection amounts of the respective evaluation regions B6, B7, B10, B11. As described above, the necessity to consider the end evaluation regions B1-B5, B8, B9, B12-B16 in determining the first processing amount U necessary for the drying processing is low in those end evaluation regions. Accordingly, the first processing amount U is determined in step S25 without considering at least one of those end evaluation regions B1-B5, B8, B9, B12-B16.

On the other hand, where a negative decision NO is obtained in step S23, namely, where it is judged that the ink ejection amounts in all of the central evaluation regions B6, B7, B10, B11 are smaller than the prescribed threshold β, step S27 is implemented without determining the first processing amount U. That is, where the ink ejection amounts in all of the central evaluation regions B6, B7, B10, B11 are smaller than the prescribed threshold β, the drying processing need not to be performed and the procedure for the drying processing is omitted. Accordingly, in an instance where a negative decision NO is obtained in step S23, it is possible to determine the maximum control amount of the post-processing mechanism 22 (FIG. 1) more quickly.

In step S27, the second processing amounts Q1-Q5, Q8, Q9, Q12-Q16 are determined for the respective end evaluation regions B1-B5, B8, 89, B12-B16 among the plurality of evaluation regions B1-B16. As described above, the necessity to determine the second processing amounts Q necessary for the curl correction processing is low in the central evaluation regions B6, B7, B10, B11. Accordingly, in step S27, at least one of procedures for determining the second processing amounts Q6, Q7, Q10, Q11 is omitted.

When the first processing amount U (in an instance where the first processing amount U is necessary) and the second processing amounts Q are determined, the maximum control amount of the post-processing mechanism 22 (FIG. 1) among the first processing amount U and the second processing amounts Q is determined in step S29. In the following step S31, the post-processing mechanism 22 (FIG. 1) is driven according to the determined maximum control amount. Thus, the drying processing and the curl correction on the recording medium P are performed. Subsequently, in step S33, it is judged whether the control of the post-processing mechanism 22 (FIG. 1) is ended or not. Where an affirmative decision YES is obtained in S33, the control is ended. Where a negative decision NO is obtained in S33, the control flow returns to step S21.

In this modified embodiment, the second processing amounts Q for the evaluation regions B except for at least one central evaluation region B located at the central portion of the recording medium P are determined. Accordingly, it is possible to promptly determine necessary second processing amounts Q. Further, the first processing amount U is determined on the basis of the ink ejection amounts of the evaluation regions B without considering at least one evaluation region B, namely, at least one end evaluation region B, located at the end portion of the recording medium P. Accordingly, the first processing amount U can be quickly determined.

Figure 9:
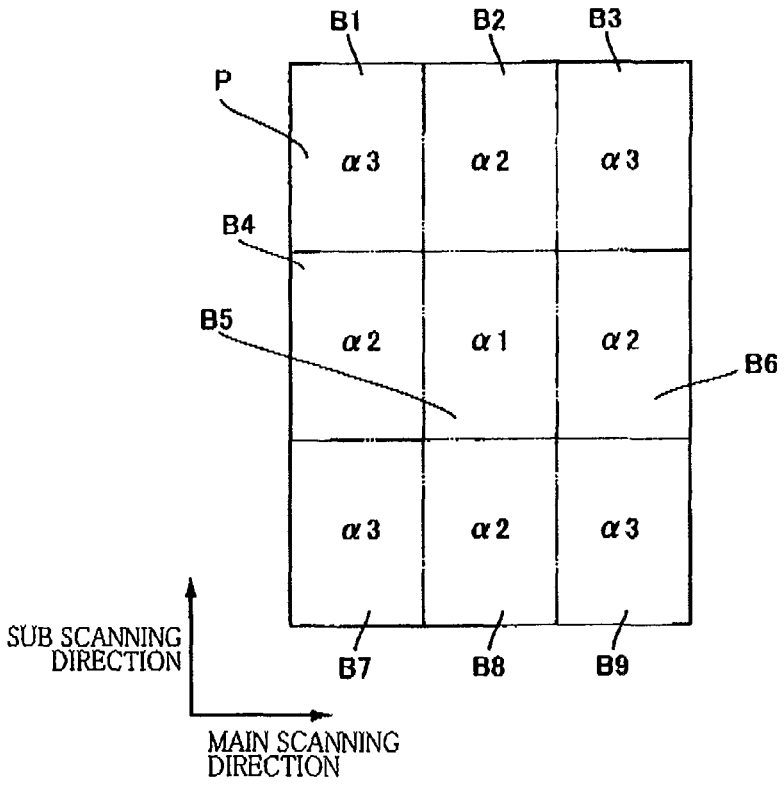
FIG. 9 is a view showing evaluation regions defined on the recording medium according to a modified embodiment.
Figure 10:
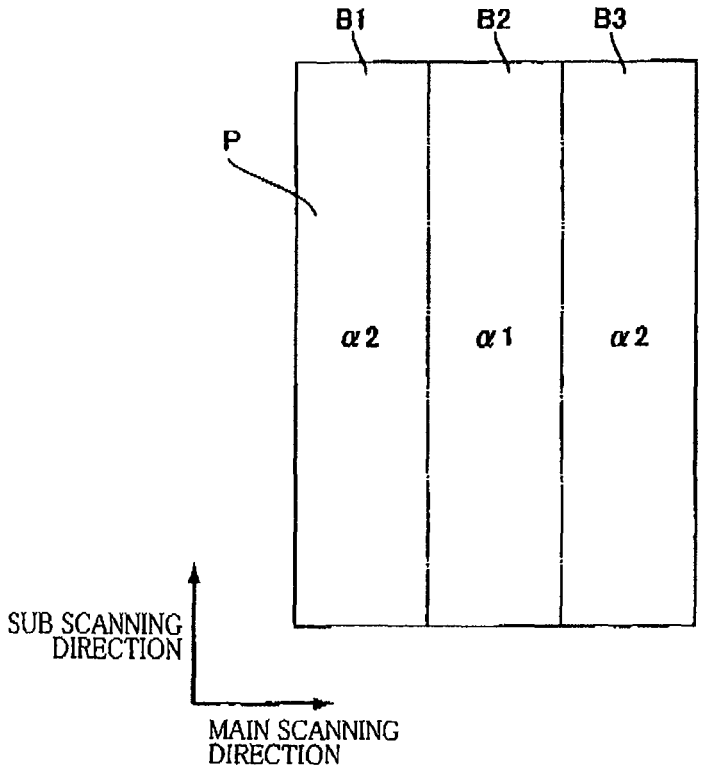
FIG. 10 is a view showing evaluation regions defined on the recording medium according to a modified embodiment.

FIG. 9 is a view showing evaluation regions B defined on the recording medium P according to a modified embodiment. FIG. 10 is a view showing evaluation regions B defined on the recording medium P according to another modified embodiment. In the illustrated embodiments, one recording medium P is divided into sixteen evaluation regions B. The number of division of the recording medium P is not particularly limited. One recording medium P may be divided into nine evaluation regions B as shown in FIG. 9 or may be divided into three evaluation regions B as shown in FIG. 10.

Where the recording medium P is divided into three rows in the sub scanning direction and three columns in the main scanning direction as shown in FIG. 9, the coefficient α1 is set for determining the second processing amount Q5 of one evaluation region B5 located at the central portion of the recording medium P and the coefficient α2 (α2>α1) is set for determining the second processing amounts Q2, Q4, Q6, Q8 of the respective four evaluation regions B2, B4, B6, B8 located at the end portion of the recording medium P (except for the four corner portions of the recording medium P). Further, the coefficient α3 (α3>α2>α1) is set for determining the second processing amounts Q1, Q3, Q7, Q9 of the respective four evaluation regions B1, B3, B7, B9 located at the respective four corner portions of the recording medium P. Where the post-processing mechanism 22 (FIG. 1) is controlled according to the flow chart of FIG. 8, the evaluation region B5 is regarded as the central evaluation region while the evaluation regions B1-B4, B6-B9 are regarded as the end evaluation regions, and steps S23-S29 are implemented.

Where the recording medium P is divided into one row in the sub scanning direction and three columns in the main scanning direction as shown in FIG. 10, the coefficient α1 is set for determining the second processing amount Q2 of the evaluation region B2 located at the central portion of the recording medium P. The coefficient $\alpha 2$ ($\alpha 2 > \alpha 1$) is set for determining the second processing amounts Q1, Q3 of the two evaluation regions B1, B3 located at the end portion of the recording medium P. Where the post-processing mechanism 22 (FIG. 1) is controlled according to the flow chart of FIG. 8, the evaluation region B2 is regarded as the central evaluation region while the evaluation regions B1, B3 are regarded as the end evaluation regions, and steps S23-S29 are implemented.

While the post-processing mechanism needs to be configured to perform, on the recording medium P, the drying processing and the curl correction processing according to a common processing technique, the post-processing mechanism is not limited to the conveyor mechanism 20 (FIG. 1) in the illustrated embodiments. For instance, the post-processing mechanism may be a drying mechanism (not shown) configured to dry the recording medium P on which an image has been formed by the ink ejection heads 72 while keeping the shape of the recording medium P. The post-processing mechanism may be both of the conveyor mechanism 20 (FIG. 1) and the drying mechanism (not shown). Where the post-processing mechanism is the drying mechanism (not shown), the drying mechanism includes a heater, an air blower, a pressing roller, etc. The output power of the heater, the operation time of the heater, the output power of the air blower, the operation time of the air blower, and the pressing time of the pressing roller correspond to the control amount of the post-processing mechanism necessary for the drying processing and the curl correction processing.

In the illustrated embodiments, the second processing-amount determining section 106 is configured to determine the second processing amount Q for each of the plurality of evaluation regions B, on the basis of the position of the evaluation region B on the recording medium P and the liquid ejection amount. The second processing-amount determining section 106 may be configured to determine the second processing amount Q on the basis of the position of the evaluation region B on the recording medium P, the liquid ejection amount, and the ink droplet number. That is, the coefficient $\alpha$ may be changed such that the larger the ink droplet number, the larger the second processing amount Q of each evaluation region B. The inventor has confirmed by experiments that the larger the droplet number, the larger the curl amount, where the ink ejection amount is the same. Therefore, by increasing the second processing amount Q with an increase in the ink droplet number, it is possible to effectively suppress an amount of the curl to occur.

The controller 24 may be constituted by a single CPU, may be constituted by a combination of a plurality of CPUs and a specific ASIC (application specific integrated circuit), or may be constituted by a combination of a single or a plurality of CPUs and a specific ASIC.

In the illustrated embodiments, the present invention is applied to the ink-jet printer 10 configured to eject ink as shown in FIG. 1. The present invention may be applied to a droplet ejection apparatus configured to eject other liquid. Further, the droplet ejection system may be a system in which droplets are ejected utilizing the pressure generated when the volume of the liquid is expanded by heat generating elements, in place of the actuator system.

What is claimed is:

1. A droplet ejection apparatus, comprising:

an image-data storage section configured to store image data based on which an image is formed on a recording medium;

a droplet ejection head configured to eject droplets of a liquid to form, on the recording medium, the image based on the image data stored in the image-data storage section;

a post-processing mechanism configured to perform drying processing and curl correction processing by a common processing technique, on the recording medium on which the image based on the image data has been formed by the droplet ejection head;

a discharged-sheet supporting portion configured to support the recording medium on which the drying processing and the curl correction processing have been performed by the post-processing mechanism; and a controller configured to:

calculate, on the basis of the image data, a liquid ejection amount that is an amount of the liquid ejected from the droplet ejection head, for each of a plurality of evaluation regions defined on the recording medium;

determine a first processing amount that is a control amount of the post-processing mechanism required for the drying processing, on the basis of a maximum one of the liquid ejection amounts of the respective evaluation regions;

determine, for each of the plurality of evaluation regions, a second processing amount that is a control amount of the post-processing mechanism required for the curl correction processing, on the basis of the liquid ejection amount and a position of the evaluation region on the recording medium; and control the post-processing mechanism to perform the drying processing and the curl correction processing on the recording medium according to a maximum control amount of the post-processing mechanism among the first processing amount and the second processing amounts of the respective evaluation regions.

2. The droplet ejection apparatus according to claim 1, wherein the controller is configured to determine the second processing amounts of the respective evaluation regions such that the second processing amount is larger in each of evaluation regions that are located at an end portion of the recording medium than in each of at least one evaluation region that is located at a central portion of the recording medium.

3. The droplet ejection apparatus according to claim 1, wherein the controller is configured to determine the second processing amounts for evaluation regions except for at least one evaluation region that is located at a central portion of the recording medium.

4. The droplet ejection apparatus according to claim 1, wherein the controller is configured to determine the first processing amount without considering at least one evaluation region that is located at an end portion of the recording medium.

5. The droplet ejection apparatus according to claim 1, wherein the controller is configured to: calculate, on the basis of the image data, a liquid droplet number that is a number of the droplets of the liquid ejected from the droplet ejection head, for each of the plurality of evaluation regions; and determine the second processing amount for each of the plurality of evaluation regions, on the basis of the position of the evaluation region on the recording medium, the liquid ejection amount, and the liquid droplet number, such that the larger the liquid droplet number, the larger the second processing amount.

6. The droplet ejection apparatus according to claim 1, wherein the controller is configured to: calculate, on the basis of the image data, a liquid droplet number that is a number of the droplets of the liquid ejected from the droplet ejection head, for each of the plurality of evaluation regions; and determine the first processing amount, such that the larger the liquid, droplet number of one of the plurality of evaluation regions based on which the first processing amount is determined, the smaller the first processing amount.

7. The droplet ejection apparatus according to claim 1, wherein the post-processing mechanism comprises a conveyor mechanism configured to convey, to the discharged-sheet supporting portion, the recording medium on which the image has been formed by the droplet ejection head while keeping a shape of the recording medium.

8. The droplet ejection apparatus according to claim 1, wherein the post-processing mechanism comprises a drying mechanism configured to dry the recording medium on which the image has been formed by the droplet ejection head while keeping a shape of the recording medium.

9. A droplet ejection apparatus, comprising:

an image-data storage section configured to store image data based on which an image is formed on a recording medium;

a droplet ejection head configured to eject droplets of a liquid to form, on the recording medium, the image based on the image data stored in the image-data storage section;

a post-processing mechanism configured to perform first processing and second processing by a common processing technique, on the recording medium on which the image based on the image data has been formed by the droplet ejection head;

a discharged-sheet supporting portion configured to support the recording medium on which the first processing and the second processing have been performed by the post-processing mechanism; and a controller configured to:

obtain a first processing amount that is a control amount of the post-processing mechanism required for a drying processing as the first processing, on the basis of at least two liquid ejection amounts each of which is an amount of the liquid for a corresponding one of a plurality of evaluation regions defined on the recording medium, the at least two liquid ejection amounts including a maximum one of a plurality of liquid ejection amounts of the respective evaluation regions;

obtain a second processing amount that is a control amount of the post-processing mechanism required for a curl correction processing as the second processing, on the basis of the liquid ejection amount and a position of the evaluation region on the recording medium; and control the post-processing mechanism to perform the first processing and the second processing according to a maximum processing amount among the first processing amount and the second processing amount.

10. A method of controlling a droplet ejection apparatus, comprising: an image-data storage section configured to store image data based on which an image is formed on a recording medium; a droplet ejection head configured to eject droplets of a liquid to form, on the recording medium, the image based on the image data stored in the image-data storage section; a post-processing mechanism configured to perform drying processing and curl correction processing by a common processing technique, on the recording medium on which the image based on the image data has been formed by the droplet ejection head; and a discharged-sheet supporting portion configured to support the recording medium on which the drying processing and the curl correction processing have been performed by the post-processing mechanism, the method comprising the steps of:

calculating, on the basis of the image data a liquid ejection amount that is an amount of the liquid ejected from the droplet ejection head, for each of a plurality of evaluation regions defined on the recording medium;

determining a first processing amount that is a control amount of the post-processing mechanism required for the drying processing, on the basis of a maximum one of the liquid ejection amounts of the respective evaluation regions;

determining, for each of the plurality of evaluation regions, a second processing amount that is a control amount of the post-processing mechanism required for the curl correction processing, on the basis of the liquid ejection amount and a position of the evaluation region on the recording medium; and controlling the post-processing mechanism to perform the drying processing and the curl correction processing on the recording medium according to a maximum control amount of the post-processing mechanism among the first processing amount and the second processing amounts of the respective evaluation regions.

* * * * *